United States Patent [19]

Tse et al.

[11] Patent Number: 4,751,016

[45] Date of Patent: Jun. 14, 1988

[54] LIQUID AQUEOUS ABRASIVE CLEANSER

[75] Inventors: James T. Tse, Alhambra; Edward J. Kaufmann, San Ramon; Gregory van Buskirk, Danville, all of Calif.

[73] Assignee: The Clorox Company, Oakland, Calif.

[21] Appl. No.: 942,664

[22] Filed: Dec. 17, 1986

Related U.S. Application Data

[63] Continuation of Ser. No. 705,580, Feb. 26, 1985, abandoned.

[51] Int. Cl.[4] ..... C11D 1/00

[52] U.S. Cl. ..... 252/174.25; 51/304; 51/309; 252/DIG. 14; 252/547

[58] Field of Search ..... 252/DIG. 14, 174.25, 252/547; 51/309, 304

[56] References Cited

U.S. PATENT DOCUMENTS

| | | | |
|---|---|---|---|
| 3,149,078 | 9/1964 | Zmoda | 252/137 |
| 3,281,367 | 10/1966 | Jones et al. | 252/112 |
| 3,715,314 | 2/1973 | Morgenstern | 252/95 |
| 3,850,833 | 11/1974 | Koceich et al. | 252/99 |
| 3,985,668 | 10/1976 | Hartman | 252/546 |
| 4,005,027 | 1/1977 | Hartman | 252/DIG. 14 |
| 4,051,056 | 9/1977 | Hartman | 252/99 |
| 4,065,409 | 12/1977 | Flanagen | 252/528 |
| 4,122,025 | 10/1978 | Kiewart et al. | 252/173 |
| 4,129,527 | 12/1978 | Clark et al. | 252/DIG. 14 |
| 4,133,779 | 1/1979 | Hellyer et al. | 282/547 |
| 4,155,870 | 5/1979 | Jorgensen | 252/131 |
| 4,158,553 | 6/1979 | Chapman | 51/304 |
| 4,240,919 | 12/1980 | Chapman | 252/95 |
| 4,283,553 | 8/1981 | Imamura et al. | 252/542 |
| 4,302,347 | 11/1981 | Straw et al. | 252/116 |
| 4,347,153 | 8/1982 | Hooper et al. | 252/174.25 |
| 4,352,678 | 10/1982 | Jones et al. | 252/99 |
| 4,394,179 | 7/1983 | Ellis et al. | 252/174.25 |
| 4,396,525 | 8/1983 | Rubin et al. | 252/174.25 |
| 4,438,016 | 3/1984 | Kiewart et al. | 252/174.25 |
| 4,457,856 | 7/1984 | Mitchell et al. | 252/166 |
| 4,534,878 | 8/1985 | Ellis et al. | 252/174.25 |

FOREIGN PATENT DOCUMENTS

| | | |
|---|---|---|
| 1048365 | 3/1979 | Canada . |
| 21545 | 1/1981 | European Pat. Off. . |
| 0021545 | 7/1981 | European Pat. Off. . |
| 1534680 | 12/1978 | United Kingdom . |
| 2031455 | 2/1983 | United Kingdom . |

*Primary Examiner*—Paul Lieberman
*Assistant Examiner*—Willie J. Thompson
*Attorney, Agent, or Firm*—Joel J. Hayashida

[57] ABSTRACT

The invention provides a homogenous, reduced scratching, liquid abrasive scouring cleanser comprising:

(1) about 10–90% by weight scouring abrasive particles with a Mohs hardness of about 2 to 4, wherein a triple tiered weight distribution of said particles comprises
   (a) about 20–99% of the weight of said particles being particles having a diameter of greater than about 100 microns;
   (b) about 5–50% of the weight of said particles being particles having a diameter greater than abut 250 microns; and
   (c) about 0–30% of the weight of said particles being particles having a diameter greater than 300 microns;

(2) a soil removal and suspension effective amount of a surfactant system comprising a mixture of anionic and nonionic surfactants; and (3) the remainder, water.

Standard adjuncts known to those skilled in the art, namely buffers, colorants, fragrances, thickeners, viscosity modifiers and further surfactants can be added to these cleansers.

11 Claims, No Drawings

LIQUID AQUEOUS ABRASIVE CLEANSER

This is a continuation of co-pending application Ser. No. 06/705,580 filed on Feb. 26, 1985, abandoned.

FIELD OF THE INVENTION

This relates to liquid abrasive scouring cleansers having improved cleaning on and causing minimized damage to hard surfaces tending to mar when abraded.

BACKGROUND OF THE INVENTION

Liquid scouring cleansers containing abrasives are well known in the art. In general, the cleansers comprise mixtures of surfactants, water and abrasives, and optionally, suspensory materials, such as clays, in order to keep the abrasive stably in suspension. Clark et al, U.S. Pat. No. 4,129,527, proposed pourable detergent compositions in which relatively small-sized abrasive particles (less than 100 mesh size, 150 microns) are combined with amine oxides and alkyl aryl sulfonates. Soft abrasives, e.g., calcite (calcium carbonate) are preferred for use. Chapman, U.S. Pat. No. 4,158,553 describes liquid scouring cleansers containing abrasives having Mohs hardness greater than 3, suspended in a mixture of soaps and anionic and/or nonionic surfactants. Canadian Patent No. 1,048,365 shows a dry, granular detergent composition containing relatively low amounts of abrasives which have relatively large particle sizes (300–850 microns) and, generally, Mohs hardness of greater than about 4. Finally, European patent application No. 22 545 shows a cleaner containing abrasives having very small particle sizes (about 15–150 microns) with a Mohs hardness of about 2–7.

As a general rule, although these aforementioned prior art cleansers may be suitable for use on such hard surfaces as counter tops, tile surfaces and grout, their use may be problematic from the standpoint of application to shiny, metallic surfaces, e.g., aluminum and steel pots and pans. For instance, these types of surfaces can become imbued with difficult-to-remove soils such as baked-on egg yolk (denatured protein) or barbecue sauce (caramelized sweeteners and oil). Cleansers such as those depicted in U.S. Pat. No. 4,129,527, appear to have little effect on such soils, due to their gentle abrading action. On the other hand, cleansers such as those of U.S. Pat. No. 4,158,553 and European patent application No. 21 545, which contain very hard abrasive particles might be effective for removal of the aforementioned problematic stains, but tend to damage or mar shiny aluminum and stainless steel surfaces on typical pots and pans used by consumers.

Nothing in the prior art shows, discloses or teaches that relatively soft abrasive particles having a larger average particle diameter will result in increased cleaning over those cleaners containing relatively soft abrasives with small average particle diameter. The art further does not show, disclose or teach that using relatively soft abrasives having a larger average particle diameter will result in reduced scratching of surfaces which have a tendency to scratch when abraded with most liquid abrasive cleansers containing hard abrasives but still result in at least equal cleaning with these hard abrasive-containing cleansers.

Moreover, nothing in the art shows, discloses or teaches that a triple tiered weight distribution of abrasive particles having a Mohs hardness of about 2–4 is crucial towards obtaining the improved cleaning of the present invention over prior art cleansers using relatively soft abrasives, while minimizing scratching of shiny surfaces which have a tendency to deface when abraded.

SUMMARY OF THE INVENTION

The invention relates to a homogenous, reduced scratching, liquid abrasive scouring cleanser comprising:

about 10–90% by weight scouring abrasives having a Mohs hardness of about 2 to 4 and a weight average particle size of about 100–400 microns, said abrasives effectively removing soil while having minimized scratching of hard surfaces tending to mar when abraded;

a soil removal and suspension effective amount of a surfactant system comprising a mixture of anionic and nonionic surfactants; and the remainder, water.

In a preferred embodiment, builders, thickeners, viscosity modifiers, buffers, colorants, fragrances and other surfactants, all of which are known to those skilled in the art, can be added to the cleansers of the invention.

The improved, reduced scratching abrasive scouring cleanser will generally use a surfactant system comprising an amine oxide and an alkyl aryl sulfonate. The preferred abrasive of choice is calcium carbonate with Mohs hardness of about 3 and an weight average particle size of about 100–400 microns.

Also provided is an improved method for cleaning hard surfaces with minimal scratching thereof, comprising applying the above liquid abrasive cleanser thereto.

In yet another preferred embodiment is provided a homogenous, reduced scratching, liquid abrasive scouring cleanser comprising:

about 10–90% by weight of the cleanser being scouring abrasive particles with a Mohs hardness of about 2 to 4, wherein a triple tiered weight distribution of said particles comprises (a) about 20–99% of the weight of said particles being particles having a diameter of greater than about 100 microns;

(b) about 5–50% of the weight of said particles being particles having a diameter greater than about 250 microns; and (c) about 0–30% of the weight of said particles being particles having a diameter greater than 300 microns.

It is therefore an object of the present invention to provide a phase stable cleanser capable of increased soil removal with minimal scratching of hard surfaces having a tendency to mar when abraded.

It is a further object of the present invention to provide a pourable cleanser safe to use on shiny surfaces of common objects with no apprehension of substantial damage thereto, while increasing the cleaning ability thereof.

DETAILED DESCRIPTION OF THE PREFERRED EMBODIMENTS

The invention provides a homogenous, reduced scratching, liquid abrasive scouring cleanser comprising;

about 10–90% by weight scouring abrasives having a Mohs hardness of about 2 to 4 and a weight average particle size of about 100–400 microns, said abrasives effectively removing soil while having minimized scratching of hard surfaces tending to deface when rubbed with abrasives;

a soil removal and suspension effective amount of a surfactant system comprising a mixture of anionic and nonionic surfactants;

and the remainder, water.

In yet another preferred embodiment is provided a homogenous, reduced scratching, liquid abrasive scouring cleanser comprising:

about 10–90% by weight of the cleanser being scouring abrasive particles with a Mohs hardness of about 2 to 4, wherein a triple tiered weight distribution of said particles comprises (a) about 20–99% of the weight of said particles being particles having a diameter of greater than about 100 microns;

(b) about 5–50% of the weight of said particles being particles having diameter greater than about 250 microns; and (c) about 0–30% of the weight of said particles being particles having a diameter greater than 300 microns.

As discussed in the Background of the Invention, there are many abrasive scouring cleansers, some of which are currently on the market. In many of the cleansers, phase stability (i.e., the elimination of separation into watery and thick phases) is problematic. These sorts of disadvantages are generally overcome by adding thickening or dispersing agents. However, even if particles are stably suspended in these liquid scouring cleansers, the nature of the particles themselves may be prone to various disadvantages. For example, applicants have found that when the weight average particle size diameter is small, i.e., less than 100 microns, soil removal is hampered. This may be because the scouring action is masked by the small size of the abrasive particle relative to the thickness of the soil, soil being present at sizes ranging from 25 microns and upwards. Although Canadian Patent No. 1,048,365 maintains that "very fine particles—through 100 mesh and finer—which are taught by the prior art as desirable for scouring purposes, are inoperative," when used in its dry, granular detergent compositions, such dry detergent formulations are free of any problems of suspension which occur in liquid formulations. Further, the dry compositions of Canadian Patent No. 1,048,365 must be wet with sufficient quantities of water in order to take advantage of the surface active properties of the surfactants incorporated therein, and thus, are usable only when there is a source of water close at hand.

Secondly, applicants have discovered that surprisingly effective cleaning and surprisingly reduced or minimized scratching of hard surfaces occur when such hard surfaces are cleaned with the abrasive-containing formulations of the present invention which incorporate abrasive particles having a Mohs hardness of about 2 to 4. As also previously mentioned, Clark et al, U.S. Pat. No. 4,129,527 disclose cleaners which have small average particle size and a Mohs hardness of less than 4. Chapman, U.S. Pat. No. 4,158,553, on the other hand uses abrasive particles which have a Mohs hardness of greater than 3. However, the abrasives used in U.S. Pat. No. 4,158,553 are so abradent that cushioning agents, notably, soaps and buffers must be present in order to prevent scratching. This is because in the examples portrayed in that patent, exceedingly hard materials such as feldspar, aluminum oxide, and zirconium silicate are used. As applicants have discovered, when abrasives of these sorts are utilized, extreme scratching occurs which can dull the surfaces of items upon which these particular abrasives are employed, e.g., mirror stainless steel surfaces of frying pans.

The following TABLE I shows the ranges of the materials used herein:

TABLE I

| MATERIAL | WEIGHT % |
|---|---|
| Abrasives | 10–90% |
| Surfactant System | |
| Anionic Surfactant | 1–10% |
| Nonionic Surfactant | 1–10% |
| Thickeners | 0–40% |
| Fragrances | .001–1.0% |
| Buffers | .05–7.5% |
| Water | Balance |

The preferred abrasives of use are calcium carbonate particles having a Mohs hardness of 2–4 and having a weight average particle size of 100–400 microns. Preferably, the weight average particle size will be more towards 150–300 microns with 90% of the particles having diameters in the range of 75–400 microns. Calcium carbonate is found naturally as limestone and is commercially available from many sources, including Georgia Marble Company. Particularly preferred is Georgia Marble 40–200.

In the abrasives of the invention, two characteristics are particularly significant: (1) the Mohs hardness of about 2–4 and (2) weight average particle size and weight distribution.

Mohs hardness is a relative scale developed by Frederic Mohs, a German mineralogist, about a century ago, in which various minerals are assigned relative values on a scale of 1 to 10, wherein 1 is talc and 10 is diamond. The scale is fairly approximate, since it is based on whether the selected mineral scratches the one preceding it in value, and the scale is not linear based on objective criteria. However, for the purposes of the present invention, Mohs hardness appears a suitable measure for the relatively soft abrasives used in the invention, namely, those with Mohs hardness of about 2 to 4, most preferably 3. TABLE II below shows a comparison between various scales of hardness:

TABLE II

| Scales of Hardness | | | | | |
|---|---|---|---|---|---|
| Mohs scale | | Ridgway's extension of Mohs scale | | Knoop scale hardness numbers, at a 100 g-load (K-100) average, kg/mm$^2$ | |
| talc | 1 | | | | |
| gypsum | 2 | | | | |
| calcite | 3 | | | | |
| fluorite | 4 | | | | |
| apatite | 5 | | | | |
| feldspar | 6 | orthoclase or periclase | 6 | | |
| quartz | 7 | vitreous pure silica | 7 | quartz | 820 |
| topaz | 8 | quartz | 8 | topaz | 1350 |

TABLE II-continued

| Scales of Hardness | | | | | |
|---|---|---|---|---|---|
| Mohs scale | | Ridgway's extension of Mohs scale | | Knoop scale hardness numbers, at a 100 g-load (K-100) average, kg/mm$^2$ | |
| corundum | 9 | topaz | 9 | corundum | 2000 |
| aluminum oxide | 9 | garnet | 10 | fused alumina | 2050 |
| silicon carbide[1] | 9.50 | fused zirconia | 11 | silicon carbide[1] | 2500 |
| boron carbide[1] | 9.75 | fused alumina | 12 | boron carbide[1] | 2800 |
| Borazon[1] (boron nitride) | 10 | silicon carbide[1] | 13 | Borazon[1] (boron nitride) | 4700 |
| diamond | 10 | boron carbide[1] | 14 | diamond | 8350? |
| | | diamond | 15 | | |

[1]Boron carbide, Borazon, silicon carbide, and aluminum oxide are manufactured abrasives. Borazon and boron carbide are relatively recent developments and the above hardness ratings are subject to some differences of opinion and differing laboratory test results. (Adapted from Kirk-Othmer, Encyclopedia of Chemical Technology, Vol. 1, p. 28 (1978)).

Particle size weight average, or weight average particle size, is a particularly significant definition for the present invention.

The prior art has suggested using abrasives of varying average particle sizes. Average particle size can be determined by measuring the size of each particle and averaging these values. Determination of the actual size of the separate particles can be quite tedious and often requires assumptions regarding the shapes of the particles. For example, the particles may actually be rhomboid, spherical, rod-like, assymetrical, etc., but these shapes must be tacitly ignored in order to arrive at an average particle size.

On the other hand, average particle size can also be determined by the following method:

First, the particles are sieved (for example, by using standard U.S. mesh size screens) to separate them by size into ranges of about 50 microns. Next, the fraction of the total weight of the particles represented by each size range is determined. This is defined as the particle size weight distribution of the particles. Then, the midpoint of each size range is determined, assuming that there are an equal number of sizes represented. (For example, within a 75 & 100 size range, one would assume there are equal numbers of particles from 75 through 100 present, and therefore, the mean of about 87.5 would be the midpoint.) The midpoint of the size range is then multiplied times the weight fraction representing that portion of the total weight in that particular size range. Finally, each of the products of this midpoint times weight fraction would be added. This results in an average which can be defined as the weight average particle size.

Sieving is accomplished by determining which particles can pass through screens of varying mesh sizes. Mesh size can be converted to microns by reference to a standard comparison table, such as TABLE III, below.

TABLE III

| Abrasives-Equivalent Sizes (On Various Scales) | | | | |
|---|---|---|---|---|
| N.S. (Hegman) | Inches | Microns | U.S. STD. No. | SIEVES Tyler Eq. Mesh |
| 7½ | 0.00025 | 6.4 | — | — |
| | 0.0004 | 10.2 | — | — |
| 7 | 0.0005 | 12.7 | — | — |
| 6½ | 0.00075 | 19.1 | — | — |
| 6 | 0.001 | 25.4 | — | — |
| | 0.0012 | 30.5 | — | — |
| 5½ | 0.00125 | 31.8 | — | — |
| 5 | 0.0015 | 38.1 | 400 | 400 |

TABLE III-continued

| Abrasives-Equivalent Sizes (On Various Scales) | | | | |
|---|---|---|---|---|
| N.S. (Hegman) | Inches | Microns | U.S. STD. No. | SIEVES Tyler Eq. Mesh |
| 4½ | 0.00175 | 44.5 | 325 | 325 |
| 4 | 0.002 | 50.8 | — | — |
| | 0.0021 | 53.3 | 270 | 270 |
| | 0.0024 | 61.0 | 230 | 250 |
| 3 | 0.0025 | 63.5 | — | — |
| | 0.0029 | 73.7 | 200 | 200 |
| 2 | 0.003 | 76.2 | — | — |
| 1 | 0.0035 | 88.9 | 170 | 170 |
| ½ | 0.00375 | 95.3 | — | — |
| | 0.0041 | 104.1 | 140 | 150 |
| | 0.0049 | 125.0 | 120 | 115 |
| | 0.0059 | 149.0 | 100 | 100 |
| | 0.0070 | 177.0 | 80 | 80 |
| | 0.0098 | 250.0 | 60 | 60 |
| | 0.0165 | 420.0 | 40 | 35 |
| | 0.0331 | 840.0 | 20 | 20 |
| | 0.0394 | 1000 | 18 | 16 |
| | 0.0469 | 1190 | 16 | 14 |
| | 0.0555 | 1410 | 14 | 12 |
| | 0.0661 | 1680 | 12 | 10 |

While determination of weight average particle size is known to those skilled in the art, the applicants surprisingly found that studying the weight distribution of the particles led to the surprising discovery that a relationship between some of the particle size weight fractions was crucial to this invention. The particular relationship discovered was a triple tiered weight distribution, the significance of which is further discussed in greater detail below.

The weight distribution of the abrasives of one of the most preferred embodiments of the present invention and the resulting weight average particle size are listed below in TABLE IV.

TABLE IV

| Abrasive Particle Size Weight Distribution | | | | | |
|---|---|---|---|---|---|
| Retained on U.S. Mesh Size | Particle Size Range (microns) | % Wt. Distribution | | | |
| 36 | >500 | 0.1 | | | |
| 45 | 375–500 | 3.5 | 16.1% | 28.1% | |
| 50 | 300–375 | 12.5 | | | |
| 60 | 250–300 | 12.0 | | | |
| 70 | 200–250 | 11.0 | | | 84.1% |
| 80 | 177–200 | 13.0 | | | |
| 100 | 150–177 | 12.0 | | | |
| 150 | 100–150 | 20.0 | | | |
| 200 | 75–100 | 10.0 | | | |

TABLE IV-continued

| Retained on U.S. Mesh Size | Abrasive Particle Size Weight Distribution: Particle Size Range (microns) | % Wt. Distribution |
|---|---|---|
| through 200 | <75 | 6.0 |

Wt. Avg. Particle Size = 196 microns

Applicants have surprisingly discovered that there is a special relationship between the weight average particle sizes and the weight distribution which appears responsible for the improved cleaning and minimal or reduced abrasion to shiny metal surfaces. As shown in TABLE IV above, a three tiered distribution which was empirically determined to be present in the cleansers of this invention, appears to be responsible for the dramatic improvement in soil removal compared to prior art cleansers using soft abrasives and in reducing the amount of damage to shiny metallic surfaces caused by prior art cleansers using hard abrasives. Evidence of these improvements in soil removal and reduction of damage is depicted below, in TABLES V and VI.

There appears to be a triple tiered relationship between the particles, wherein weight distribution of particles occurs in three tiers: (1) particles above about 100 microns; (2) particles above about 250 microns; and (3) particles above about 300 microns.

Therefore, it appears that to obtain the desired improved cleaning and minimized damage to shiny metal surfaces aimed for in this invention the particle weight distribution preferably occurs when the first tier, defined as particles with a particle size exceeding about 100 microns, comprises about 20–99% of of the total weight of the particles; the second tier, defined as particles with a particle size exceeding about 250 microns, comprises about 5–50% of the total weight of the particles; and the third tier, defined as particles with a particle size exceeding about 300 microns, comprises about 0–30% of the total weight of the particles. More preferably, the first tier comprises about 25–95%, the second tier comprises about 15–40% and the third comprises about 10–25%. Most preferably, the relationships are about 75–85%; about 20–30%; and 15–20%.

The surfactant system comprises a mixture of anionic and nonionic surfactants. Applicants have found that for best soil removal and suspensory properties, a mixture of alkyl aryl sulfonates (anionic) and amine oxides (polar nonionic) surfactants is best for this particular system. The alkyl aryl sulfonates include alkyl aryl sulfonic acid ("HLAS") and its alkali metal salts. Particularly preferred is Calsoft L-40, which is a 40% aqueous solution of a sodium salt of alkyl benzene sulfonic acid averaging 11.5 carbons in the alkyl chain manufactured by Pilot Chemical Company. The tertiary amine oxides have the structure set forth below

Figure I

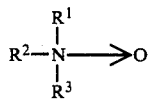

wherein $R^1$ and $R^3$ are $C_{1-4}$ alkyls, or $C_{1-4}$ alkoxyls, and $R^2$ is $C_{6-24}$ alkyl. Especially preferred is a lauryl dimethyl amine oxide available from Lonza Corporation under the trademark "Lonzaine." Other polar nonionic surfactants, e.g., phosphine oxides and sulfoxides, may be suitable. Amphoteric surfactants, such as alkyl betaines, may also be appropriate for use herein.

The amounts of at least two surfactants present in the surfactant system should be sufficient such that effective soil removal and suspension occurs. Effective soil removal occurs when, using a Gardner Wear-tester to evaluate soil removal, an average of less than about 200 strokes on the Gardner Wear-tester is required to remove 90% of the soil. (Lesser strokes to remove=better results). A suspension effective amount of the surfactant system is present when no phase separation is seen to occur (i.e., less than 10% syneresis occurs) after storage in extreme cold and heat conditions.

Although the relationship between the amine oxide and the alkyl aryl sulfonate is not critical, it has been found that optimum suspendability and soil removal occurs when the surfactants are in a relationship of about preferably 1:10 to 10:1 amine oxide: alkyl aryl sulfonate, more preferably 1:4 to 4:1, and most preferably 2:1 to 1:5.

Additionally, the relationship between the particulate abrasives and the surfactant system is such that a yield value of about 100–1,500 centipoise as measured at room temperature on a Brookfield RVT Viscometer occurs. It is most preferable that a yield value of about 200–1,000 centipoise occurs.

Other components of the inventive cleansers include those which are known generally to those skilled in the art.

For example, a thickener is desirable to include in the cleansers to improve abrasive suspending ability. Suitable thickeners include very low average particle size calcium carbonate, such as that sold under the brand name Gama-Sperse 80 (average 2 micron particle diameter), available from Georgia Marble Company. The level of thickener is about 0 to 60%, more preferably about 1 to 25%, and most preferably about 1 to 10%. Although calcium carbonate of very small average particle size (1 to 20 microns) is desirable, other thickeners, such as finely divided mica may be useful. Harder particles, such as silica may not be as suitable for use due to increased scratching of surfaces. It should also be noted that the calcium carbonate thickener does not also impart any perceivable abrasion. Instead for cleaning, the discovered triple tiered weight distribution among the large weight average particle size calcium carbonate is necessary for cleaning. However, since insoluble particulate matter may itself lend some thickening, albeit not a large amount due to its reduced surface area, applicants have found that when the abrasive level is increased to about 50% or greater, smaller amounts of thickener are needed.

A viscosity modifier, such as citric acid (which, at the alkaline pH prevalent in the inventive cleansers, forms a citrate salt) or a citrate salt thereof, is desirable to further otimize rheology. Levels of about 0 to 10%, more preferably about 1 to 7%, and most preferably about 1 to 5% are desirable. Other viscosity modifiers and multiple ionic salts include the alkali metal salts of phosphates, polyphosphates, pyrophosphates, triphosphates, tetraphosphates, silicates, metasilicates, polysilicates, carbonates, hydroxides, and mixtures thereof. The viscosity modifier apparently modifies the liquid environment, interacting with the thickener and the buffer to optimize rheology.

A buffer should also be present to maintain the pH, at desirably greater than 8, more preferably about 9 or more, most preferably about 10. The buffer or pH modifier of choice is sodium carbonate. Sodium bicarbonate, potassium carbonate, possibly lithium carbonate and the alkali metal salts of borates are also possible. pH can also be adjusted by adding hydrochloric acid or sodium hydroxide to the buffer to obtain pH values desired. About 0.01 to 10%, more preferably 0.05 to 7.5%, most preferably about 0.1 to 6% buffer is added to obtain the desired pH.

Other adjuncts to the cleaners include colorants, such as dyes, pigments (e.g., ultramarine blue), although it is desirable to keep the cleansers white or a pale color for esthetic purposes and to avoid potential staining. One supplier of dyes is Sandoz A. G. Fragrances are also desirable and are available in proprietary formulas from Firmenich, International Flavors and Fragrances and Givaudan. Other adjuncts include further surfactants to increase soil removal and hypochlorite bleach, if stabily incorporatable. Builders, such as sodium tripolyphosphate, if desired, could be included.

EXPERIMENTAL

In order to assess the advantages of the inventive cleansers, comparison studies were conducted with abrasives which were harder (feldspar and silica) and one with the same Mohs hardness but smaller particle size. The results are depicted in TABLES V and VI.

Review of the two TABLES shows exactly why the results obtained by using the relatively soft, larger particle size abrasives of the present invention achieves such surprisingly effective cleaning with reduced scratching of surfaces tending to deface when abraded.

In these tests depicted in TABLES V and VI, commercially available shiny-surfaced aluminum and stainless steel coupons were chosen as the work surface. Generally speaking, egg yolk soil was applied to aluminum surfaces and barbecue sauce soil was applied to stainless steel surfaces, although in testing it was discovered that the surfaces could be interchanged with the expectation of consistent results. These types, of metals are most prevalent in common household pots and pans.

TABLE V shows that comparisons of three different abrasives of differing Mohs hardnesses of, respectively, 7, 6 and 3, at three different levels of abrasive (6, 28 and 50%, respectively) demonstrate the particular advantages of the invention.

Soil removal ability was assessed by measuring the strokes of a Gardner Wear-tester to remove baked on barbeque sauce and egg yolk soils. In assaying the test, fewer strokes needed to remove the soil indicates better cleaning performance.

The procedure for the soil removal tests was as follows: A uniform thickness of soil (egg yolk or barbecue sauce) was applied to metal coupons and the coupons were baked to harden the soil under realistic home-use conditions. The effectiveness of the abrasives in soil removed was measured by applying 3 g of various formulations, containing base formula[1] including, respectively, 6%, 28% and 50% of the identified abrasives to a damp sponge, placing the sponge in a Gardner Wear-tester under a weight of 1,364 g and measuring the strokes required to remove 90% of the soil. After 30 strokes, 3 more grams of formula were added to the sponge.

[1] Base Formula: Calsoft L-40, 7% (40% active); Lonzaine, 6.67% (30% active); Thickener, 0–40%; Viscosity Modifier (sodium citrate dihydrate), 2%; Fragrance, 0.3%; Dye, 0.01%; Na2CO3, 0.09%; Minors, 0.05%; Water and Abrasives, Balance In the abrasion test, the results of which are depicted in TABLE VI, clean aluminum and stainless steel coupons were treated with a sponge, to which had been applied 3 g of the desired formulation, under a weight of 1,364 g, using a Gardner Wear-Tester. The sponge was moved across the coupon perpendicular to the grain of the metal for a specified number of cycles with 3 g of the formulation added to the sponge after each 25 strokes and the reflectance (incident light parallel to the grain of the metal) was measured before and after treatment. The larger the change in reflectance ($R_{Final}$—$R_{Initial}$), the more the surface was scratched. The results are reported in TABLE VI.

Review of TABLE V shows that silica having a Mohs hardness of about 7 with an average particle size of 300 microns has improved performance as abrasive levels are increased from 6 to 28 to 50%. The same relative advantages are noted for feldspar having a Mohs hardness of about 6 and an average particle size of about 350 microns. However, it is especially notable that the calcium carbonate having a Mohs hardness of about 3 and a weight average particle size of about 200 microns surprisingly greatly increased its soil removing abilities as the abrasive level is increased. At 50% levels, the calcium carbonate performs at parity with both feldspar and silica, even though both of those particular abrasives are not only harder but larger in average particle size.

However, when TABLE VI is consulted, the particular advantages of these large particle size calcium carbonate particles is apparent. As the abrasive level is increased in the three systems, it is notable that the feldspar and silica abrasives cause an increasing amount of damage to shiny aluminum and stainless steel surfaces. The inventive cleaners containing the large size calcium carbonate particles, however, show minimal damage which is comparable to that achieved by the control, which is a commercially available cleanser containing a small average particle size (~25 microns) calcium carbonate. As attested to in TABLE V, however, cleaning is surprisingly much greater using the larger particle size as compared to the control.

TABLE V

Comparing Soil Removal Abilities of Different Abrasives

| | | | | Strokes to Remove 90% of Soil | | | | | |
|---|---|---|---|---|---|---|---|---|---|
| Cleaner | Abrasive | Average Particle Size | Mohs Hardness | 6% | | 28% | | 50% | |
| 1 | Silica | 300 Microns | 7 | 70[1] | 183[2] | 56[1] | 142[2] | 44[1] | 112[2] |
| 2 | Feldspar | 350 Microns | 6 | 101[1] | 160[2] | 45[1] | 105[2] | 41[1] | 95[2] |
| 3 | Calcium Carbonate | 190 Microns | 3 | 124[1] | 161[2] | 64[1] | 141[2] | 39[1] | 100[2] |
| Control | Calcium | 25 Microns | 3 | | | | | 93[3] | 202[4] |

TABLE V-continued

| Comparing Soil Removal Abilities of Different Abrasives | | | | | | |
|---|---|---|---|---|---|---|
| | | | | Strokes to Remove 90% of Soil | | |
| Cleaner | Abrasive | Average Particle Size | Mohs Hardness | 6% | 28% | 50% |
| | Carbonate | | | | | |

[1]Soil is egg yolk, using Gardner Wear-Tester protocol previously described. Fewer strokes indicates better cleaning. Substrate cleaned was an aluminum coupon.
[2]Soil is barbecue sauce, using Gardner Wear-Tester protocol previously described. Fewer strokes indicates better cleaning. Substrate cleaned was a stainless steel coupon.
[3]Control value obtained only at 50% abrasive levels.
[4]Control value obtained only at 50% abrasive levels.

TABLE VI

| Comparing Effect of Different Abrasives on Polished Surfaces | | | | | | | |
|---|---|---|---|---|---|---|---|
| | | | | Abrasiveness on Aluminum and Stainless Steel Surfaces Measured at ΔR | | | |
| Cleaner | Abrasive | Average Particle Size | Mohs Hardness | 28% | | 50% | |
| 1 | Silica | 300 Microns | 7 | 41.7[1] | 13.0[2] | 80.8[1] | 13.1[2] |
| 2 | Feldspar | 350 Microns | 6 | 51.5[1] | 7.7[2] | 87.4[1] | 11.0[2] |
| 3 | Calcium Carbonate | 190 Microns | 3 | 44.2[1] | 1.3[2] | 66.2[1] | 1.1[2] |
| Control | Calcium Carbonate | 25 Microns | 3 | | | 31.6[3] | .79[4] |

[1]ΔR with grain on aluminum.
[2]ΔR with grain on stainless steel.
[3]ΔR with grain on aluminum for control, which was run at 50% abrasive levels.
[4]ΔR with grain on stainless steel for control, which was run at 50% abrasive levels.

While the foregoing embodiments and objects delineate the present invention, nothing herein is intended to restrict the scope of the invention to obvious equivalents which would be known to those skilled in the art. For instance, although a three tier weight distribution of particles is believed responsible for the improved cleaning with minimized scratching, in fact, a further tier may also be significant, e.g., the fraction containing weight average particles greater than 150 microns. The invention is further defined in a non-limiting fashion by the claims which follow hereto.

What is claimed is:

1. A homogenous, reduced scratching, liquid abrasive scouring cleanser comprising:

(1) about 10–99% by weight scouring abrasive particles with a Mohs hardness of about 2 to 4, is a three tiered weight distribution of said particles, said distribution comprising:

(a) about 20 to 99% of the weight of said particles being particles having a diameter of greater than 100 microns;

(b) about 15 to 40% of the weight of said particles being particles having a diameter greater than 250 microns; and (c) about 10 to 25% fo the weight of said particles being particles having a diameter greater than 300 microns;

(2) a soil removal and suspension effective amount of a surfactant system which comprises a mixture of anionic and nonionic surfactants; and (3) the remainder, water.

2. The cleanser of claim 1 wherein at least about 25% of the abrasives must have a particle size greater than about 100 microns.

3. The cleanser of claim 1 wherein the abrasive is present in an amount of about 50%, and about 90% of the abrasive particles have diameter in the range of 75–400 microns.

4. The cleanser of claim 1 wherein said surfactant system further comprises an amine oxide and an alkyl aryl sulfonate.

5. The cleanser of claim 4 wherein said amine oxide is present in an amount of about 1.0 to 10.0% by weight and said alkyl aryl sulfonate is present in an amount of about 1.0 to 10.0% by weight.

6. The cleanser of claim 5 wherein said amine oxide and said alkyl aryl sulfonate are present in a ratio of about 1:4 to 4:1.

7. The cleanser of claim 1 wherein said abrasive is calcium carbonate.

8. The cleanser of claim 1 wherein said cleanser has a yield value of about 100–1,500 centipoise as measured at room temperature on a Brookfield RVT Viscometer.

9. The cleanser of claim 1 wherein said particles of (a) are present in an amount of about 25 to 90%.

10. A method of cleaning soiled hard surfaces which tend to mar when abraded wherein minimal scartching is achieved despite substantially complete removal of the soil thereon said method comprising repeatedly reciprocating said surface with the cleanser of claim 1.

11. A homogenous reduced scratching, liquid abrasive scouring cleanser comprising:

(1) at leat about 50% by weight scouring abrasive particles with a Mohs hardness of about 2 to 4, said abrasive particles effectively removing soil while having minimized scratching of hard surfaces tending to mar when abraded, wherein no cushioning agents such as soaps are required, said particles being in a three tiered weight distribution, said distribution comprising:

(a) about 20 to 99% of the weight of said particles being particles having a diameter of greater than 100 microns;

(b) about 5 to 50% of the weight of said particles being particles having a diameter greater than 250 microns; and (c) about 10 to 25% of the weight of said particles being particles having a diameter greater than 300 microns;

(2) a soil removal and suspension effective amount of a surfactant system which comprises a mixture of anionic and nonionic surfactants;

(3) a buffer to maintain the pH at about at least 10; and (4) the remainder, water.

* * * * *